US008960965B2

(12) United States Patent
Horng

(10) Patent No.: US 8,960,965 B2
(45) Date of Patent: Feb. 24, 2015

(54) LAMP

(71) Applicant: Sunonwealth Electric Machine Industry Co., Ltd., Kaohsiung (TW)

(72) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 170 days.

(21) Appl. No.: 13/710,934

(22) Filed: Dec. 11, 2012

(65) Prior Publication Data

US 2013/0294094 A1 Nov. 7, 2013

(30) Foreign Application Priority Data

May 3, 2012 (TW) ..... 101115836 A

(51) Int. Cl.

| | |
|---|---|
| ***F21V 29/00*** | (2006.01) |
| ***F21V 29/02*** | (2006.01) |
| ***F21K 99/00*** | (2010.01) |
| ***F21S 8/04*** | (2006.01) |
| *F21V 3/00* | (2006.01) |
| *F21Y 101/02* | (2006.01) |
| *F21Y 105/00* | (2006.01) |

(52) U.S. Cl.

CPC ..... *F21V 29/02* (2013.01); *F21V 29/2206* (2013.01); *F21V 29/225* (2013.01); *F21K 9/135* (2013.01); *F21S 8/04* (2013.01); *F21V 29/027* (2013.01); *F21V 3/00* (2013.01); *F21Y 2101/02* (2013.01); *F21Y 2105/001* (2013.01); *Y10S 362/80* (2013.01)

USPC ..... 362/294; 362/249.02; 362/311.02; 362/650; 362/800

(58) Field of Classification Search

CPC ..... F21K 9/135; F21V 29/02; F21V 29/027; F21V 29/2206; F21V 29/225; F21V 29/2256; F21V 29/2262

USPC ..... 362/249.02, 294, 311.02, 650, 800

See application file for complete search history.

(56) References Cited

U.S. PATENT DOCUMENTS

| | | | |
|---|---|---|---|
| 2006/0193139 | A1 | 8/2006 | Sun et al. |
| 2012/0236576 | A1 | 9/2012 | Fang et al. |

FOREIGN PATENT DOCUMENTS

| | | |
|---|---|---|
| CA | 202118600 U | 1/2012 |
| TW | M346745 | 12/2008 |
| TW | I316121 | 10/2009 |
| TW | M372927 | 1/2010 |
| TW | I334528 | 12/2010 |

*Primary Examiner* — Jason Moon Han

(74) *Attorney, Agent, or Firm* — Muncy, Geissler, Olds & Lowe, P.C.

(57) ABSTRACT

A lamp including the following elements is provided. A housing has an assembling opening and an electrical base on two ends thereof, wherein the housing has an inner wall and a portion of the inner wall adjacent to the assembling opening is an air-guiding wall. A cooling fan has a casing disposed at the assembling opening and forming an air channel, a fan wheel rotatably arranged in the air channel, and at least one partitioning board between the air-guiding wall and the air channel so as to define at least one first air-guiding opening and at least one second air-guiding opening. A light-emitting module is arranged in the housing and opposite to the fan wheel. Accordingly, the present lamp does not require forming any air inlet or air outlet on the housing, and thus provides a simplifier structure.

12 Claims, 9 Drawing Sheets

LAMP

BACKGROUND OF THE INVENTION

1. Field of the Invention

The present invention generally relates to a lamp and, more particularly, to a lamp with cooling function.

2. Description of the Related Art

Referring to FIG. 1, Taiwanese Patent No. 1316121 discloses a conventional lamp 8 with a housing 81. The conventional lamp 8 consists of a first housing 811 and a second housing 812. The first housing 811 has an air outlet 811*a* and the second housing 812 has an air inlet 812*a*. The housing 81 has a heat sink 82, a light-emitting element 83 and a cooling fan 84, with the heat sink 82 disposed between the light-emitting element 83 and the cooling fan 84. Based on the structure, the cooling fan 84 may draw the external air into the conventional lamp 8 via the air inlet 812*a*. The drawn air will travel through the heat sink 82 and be expelled from the conventional lamp 8 via the air outlet 811*a*. Thus, heat generated by the light-emitting element 83 can be dissipated.

However, since the housing 81 consists of at least two housings (first and second housings 811 and 812), more components are used and the overall structure of the conventional lamp 8 is more complex. In addition, the conventional lamp 8 requires forming a plurality of holes on the housing 81 as the air outlet 811*a* and the air inlet 812*a*, it will be more difficult to manufacture the conventional lamp 8. This results in an increment in manufacturing costs.

Besides, the conventional lamp 8 should be partially inserted into a decorative ceiling consisting of a plurality of ceiling panels for aesthetic consideration. Therefore, the air outlet 811*a* and the air inlet 812*a* will be settled into a confined space above the decorative ceiling where the ventilation is poor. As a result, the heat of the lamp will accumulate in the confined space, shortening the service life of the conventional lamp 8.

Referring to FIG. 2, Taiwanese Patent No. M346745 discloses another conventional lamp 9 comprising a housing 91, a heat sink 92, a fan 93 and a light-emitting diode (LED) unit 94. The housing 91 consists of an upper housing 911 and a lower housing 912. The upper housing 911 has a plurality of vents 911*a* and the lower housing 912 has a through hole 912*a*. The heat sink 92 is disposed in the housing 91, with an air channel 95 formed between the heat sink 92 and the through hole 912*a* of the lower housing 912. The fan 93 is also disposed in the housing 91 and coupled with the heat sink 92. The LED unit 94 is coupled with the heat sink 92. In such an arrangement, the external air can be drawn into the conventional lamp 9 via the vents 911*a* and the air inside the conventional lamp 9 can be expelled via the air channel 95 and the through hole 912*a*, thereby dissipating the heat generated by the LED unit 94.

However, the conventional lamp 9 also contains two housings (the upper and lower housings 911 and 912) and therefore has larger component consumption and more complex structure. Furthermore, the conventional lamp 9 still requires forming the vents 911*a* on the upper housing 911 even though the air channel 95 has been provided between the heat sink 92 and the through hole 912*a*. Therefore, the conventional lamp 9 has the same drawbacks of inconvenient processing and high manufacturing costs as the conventional lamp 8. When the conventional lamp 9 is partially inserted into the decorative ceiling, the vents 911*a* is still settled into the confined space above the decorative ceiling although the air channel 95 is located outside the confined space beneath the decorative ceiling for better air convection. Thus, the conventional lamp 9 still has poor cooling efficiency, which shortens the service life thereof.

SUMMARY OF THE INVENTION

It is therefore the objective of this invention to provide a lamp which does not require forming any air inlet or outlet on a housing thereof. Thus, the lamp will have a simplified structure and is easy to manufacture.

It is another objective of this invention to provide a lamp which ensures the external air to flow into and out of the lamp smoothly when the lamp is partially inserted into a decorative ceiling. Thus, the lamp will have better heat dissipation and normal operation.

The embodiment of the invention discloses a lamp including a housing, a cooling fan and a light-emitting module. The housing has an assembling opening and an electrical base on two ends thereof, wherein the housing has an inner wall and a portion of the inner wall adjacent to the assembling opening is an air-guiding wall. The cooling fan has a casing, a fan wheel and at least one partitioning board, wherein the casing is disposed at the assembling opening and forming an air channel therein, the fan wheel is rotatably arranged in the air channel, and the at least one partitioning board is arrange between the air-guiding wall of the housing and the air channel, with each partitioning board having a first end and a second end, with the first and second ends facing and abutting against the air-guiding wall of the housing respectively so as to define at least one first air-guiding opening and at least one second air-guiding opening. The light-emitting module is arranged in the housing.

A heat sink having a base plate fixed inside the housing is further comprised, with the cooling fan and the light-emitting module mounted on the base plate.

A number of the at least one partitioning board is two and these two partitioning boards are arranged at two lateral edges of the casing respectively and extend axially toward the assembling opening, a number of the at least one first air-guiding opening is two while each of these two first air-guiding openings is defined between the air-guiding wall and a respective one of the two partitioning boards, and a number of the at least one second air-guiding opening is one while the second air-guiding opening is defined between the two partitioning boards and the air channel.

A number of the at least one partitioning board is one and the partitioning board is on a side of the casing, with the said side of the casing facing the assembling opening, a number of the at least one first air-guiding opening is one while the first air-guiding opening is defined between the air-guiding wall and an outer surface of the partitioning board, and a number of the at least one second air-guiding opening is one while the second air-guiding opening is defined between an inner surface of the partitioning board and the air channel.

The housing is closed between the assembling opening and the electrical base.

A light-permeable hood coupled with the heat sink is further comprised, wherein the light-permeable hood has an opening portion and the light-emitting module is received in the light-permeable hood through the opening portion.

The light-permeable hood has an air-guiding shoulder portion, and an air-guiding gap is formed between the air-guiding shoulder portion and one end of the housing adjacent to the assembling opening.

The at least one partitioning board is integrally formed on the casing.

The at least one partitioning board is detachably mounted on the casing.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
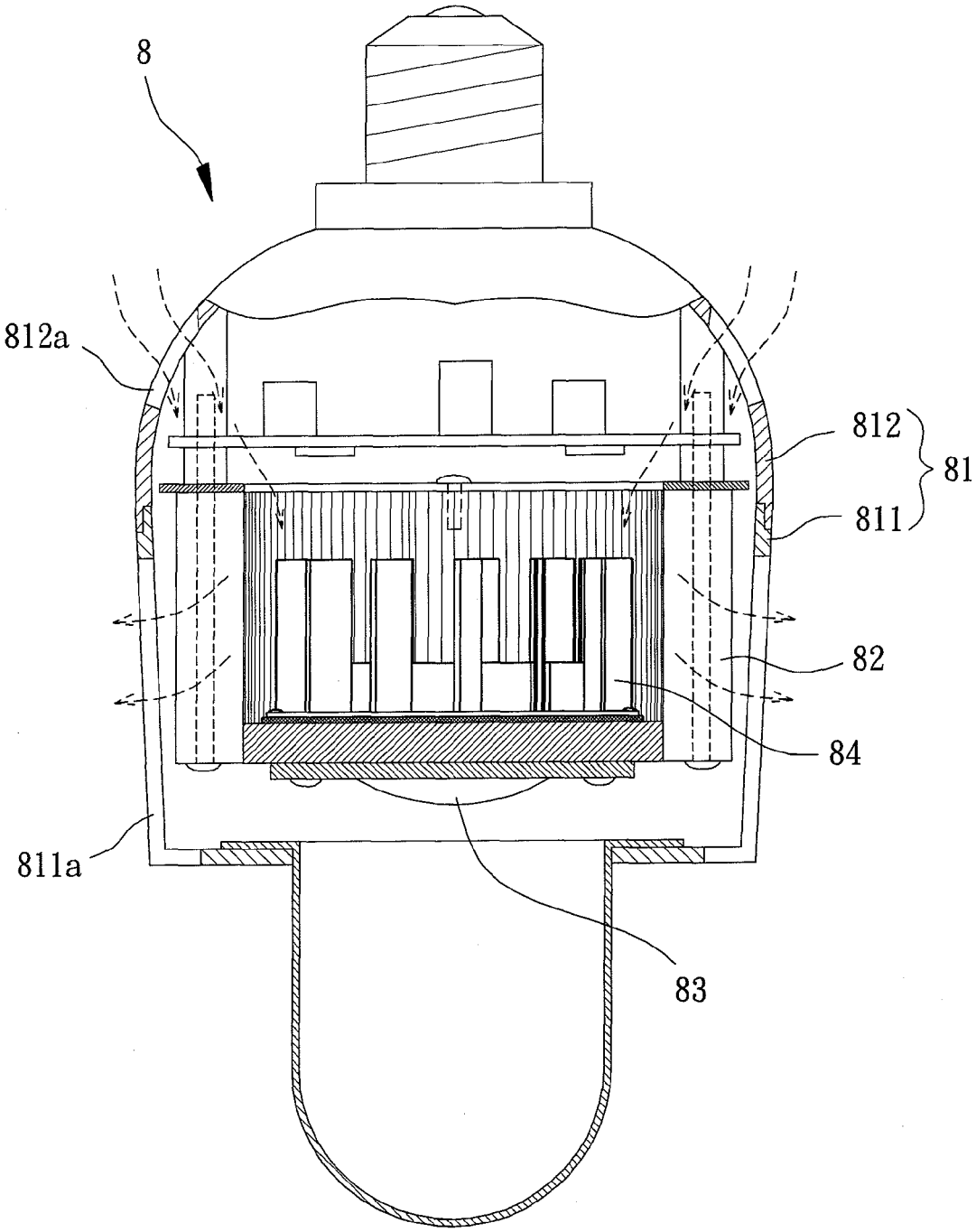
FIG. 1 PRIOR ART
FIG. 1 shows a cross-sectional view of a conventional lamp.
Figure 2:
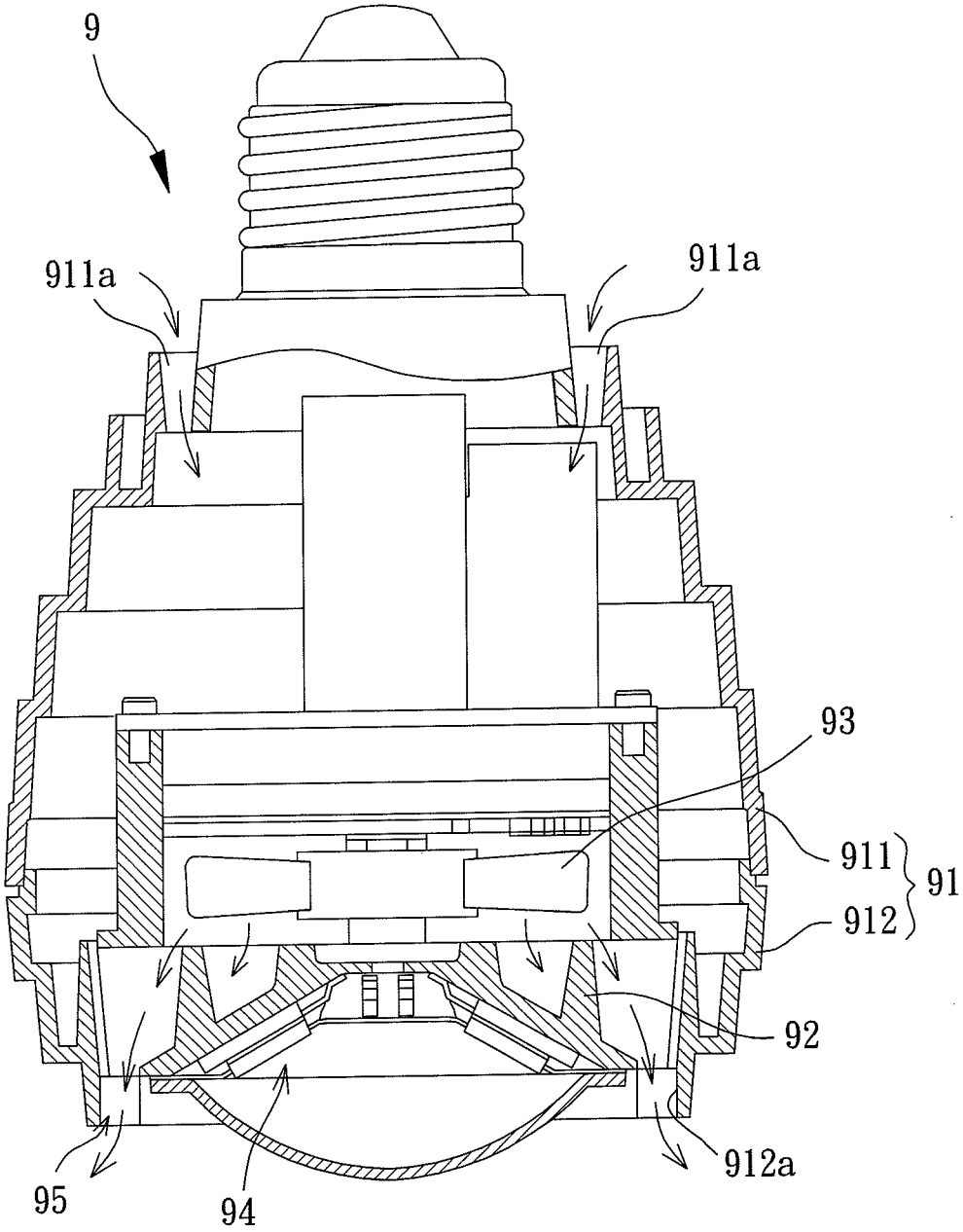
FIG. 2 PRIOR ART
FIG. 2 shows a cross-sectional view of another conventional lamp.

In the various figures of the drawings, the same numerals designate the same or similar parts. Furthermore, when the term "first," "second," "inner," "outer," "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 3:
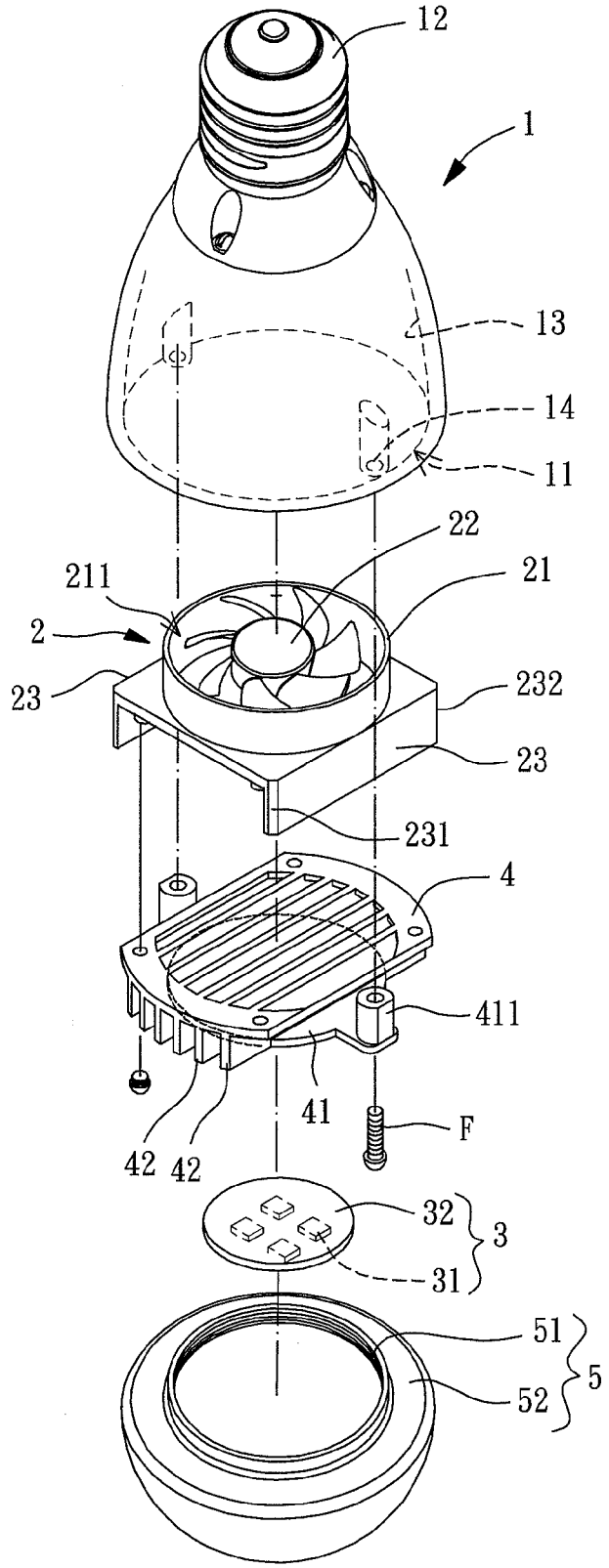
FIG. 3 shows an exploded diagram of a lamp according to a first embodiment of the invention.
Figure 4:
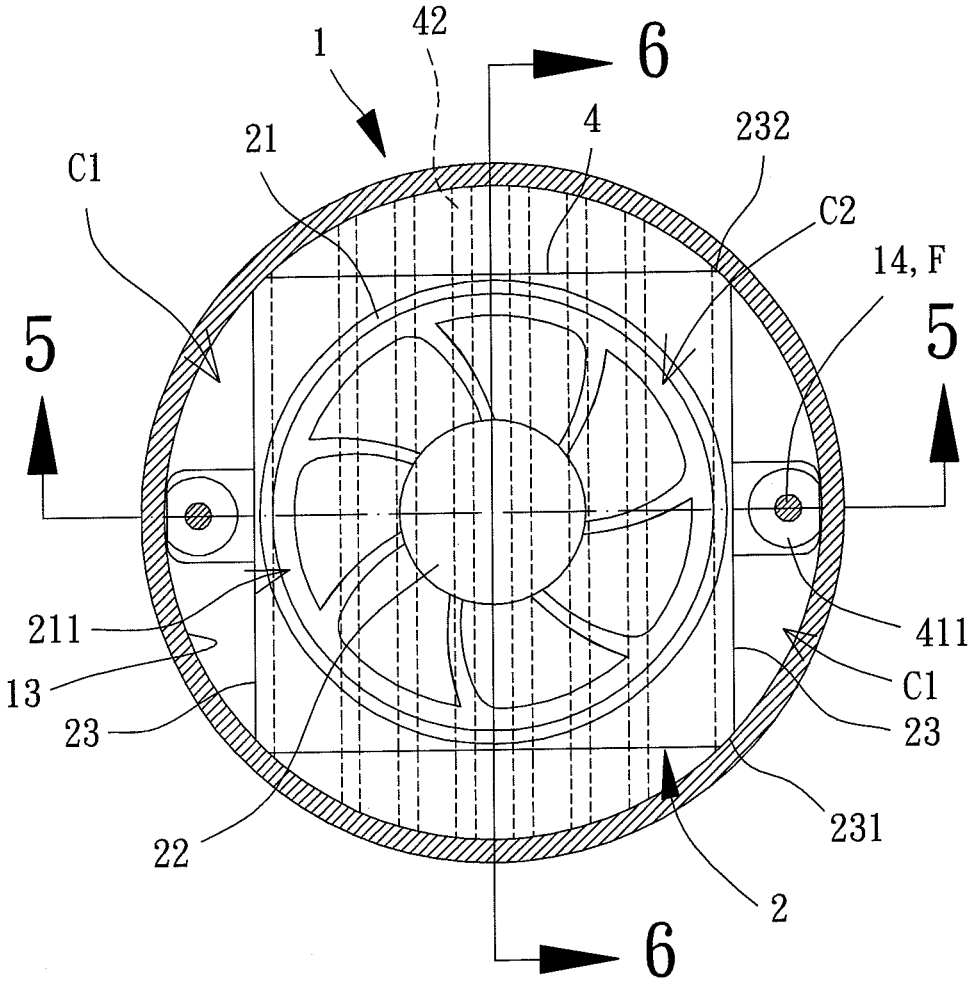
FIG. 4 shows a cross-sectional view of the lamp according to the first embodiment of the invention.

Referring to FIGS. 3 and 4, a first embodiment of the lamp of the invention, which includes a lamp having at least a housing 1, a cooling fan 2 and a light-emitting module 3, is disclosed. The housing 1 is provided to couple with the cooling fan 2 and the light-emitting module 3. The cooling fan 2 and light-emitting module 3 are received inside the housing 1 so that the cooling fan 2 can dissipate the heat generated by the light-emitting module 3 in operation.

The housing 1 is hollow and has an assembling opening 11 on one end thereof and an electrical base 12 on the other end thereof. The assembling opening 11 communicates with an interior room of the housing 1 so that the cooling fan 2 can be disposed in the interior room of the housing 1 via the assembling opening 11. The housing 1 has an inner wall defining the interior room, and a portion of the inner wall adjacent to the assembling opening 11 is defined as an air-guiding wall 13 hereinafter. The electrical base 12 is in a form capable of providing electrical connection to an external power supply. Specifically, the inner wall of the housing 1 is closed between the assembling opening 11 and the electrical base 12.

The cooling fan 2 may be an axial flow fan or a centrifugal fan, with the axial flow fan preferred. In addition, the cooling fan 2 has a casing 21 disposed at the assembling opening 11 of the housing 1 by screwing, hooking, welding or adhesion. Moreover, the casing 21 can also be positioned at the assembling opening 11 by fixing to the housing 1 through a heat sink 4, with the shape of the casing 21 not be limited but preferably matching that of the heat sink 4. An air channel 211 is formed in the casing 21 for air current to pass through. A fan wheel 22 of the cooling fan 2 is rotatably arranged in the air channel 211, with the fan wheel 22 having a magnet and serving as a rotor, so as to be driven by a stator of the cooling fan 2 through the said magnet.

Figure 5:
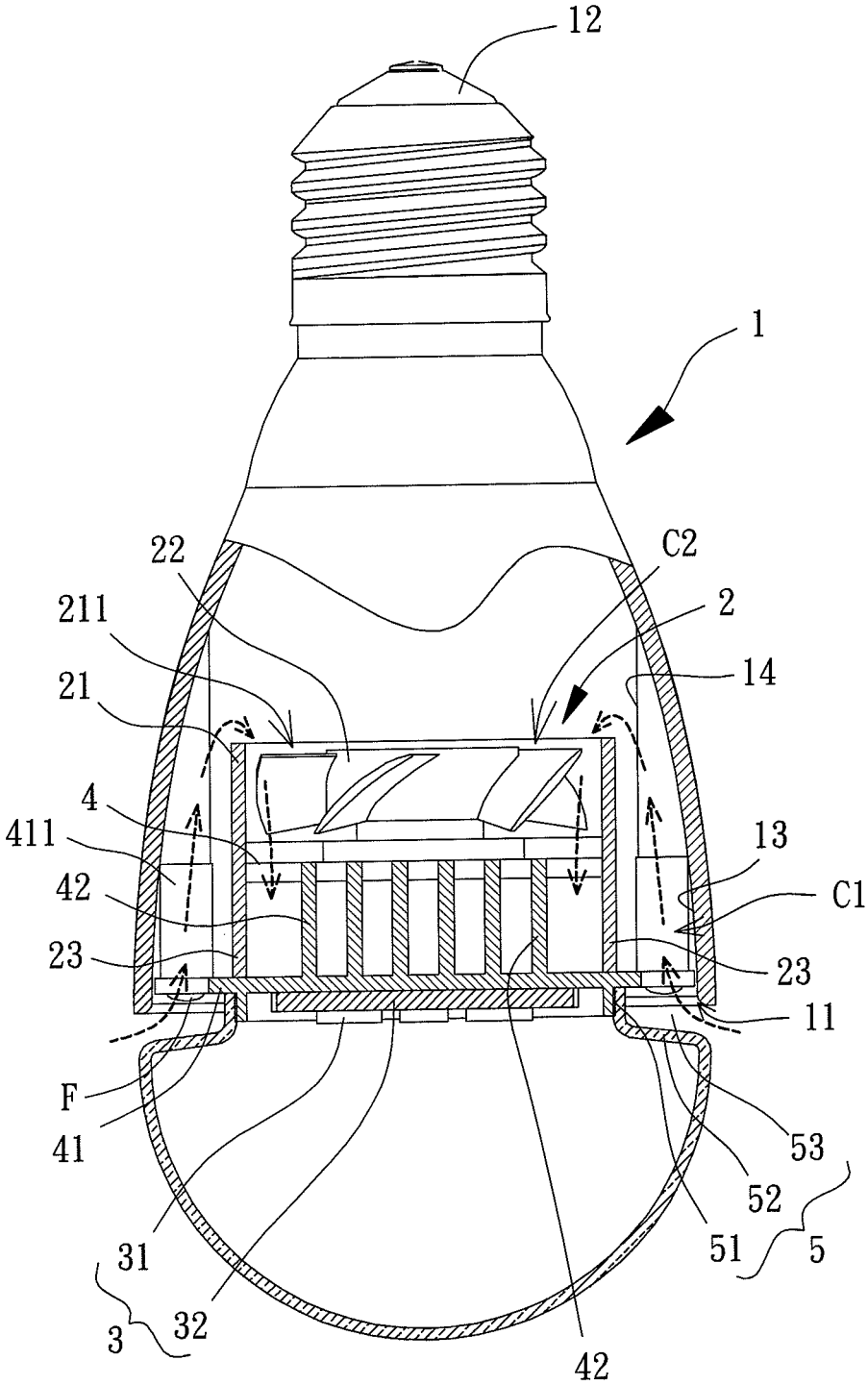
FIG. 5 shows a cross-sectional view of the lamp according to the first embodiment observed at line 5-5 in FIG. 4.
Figure 6:
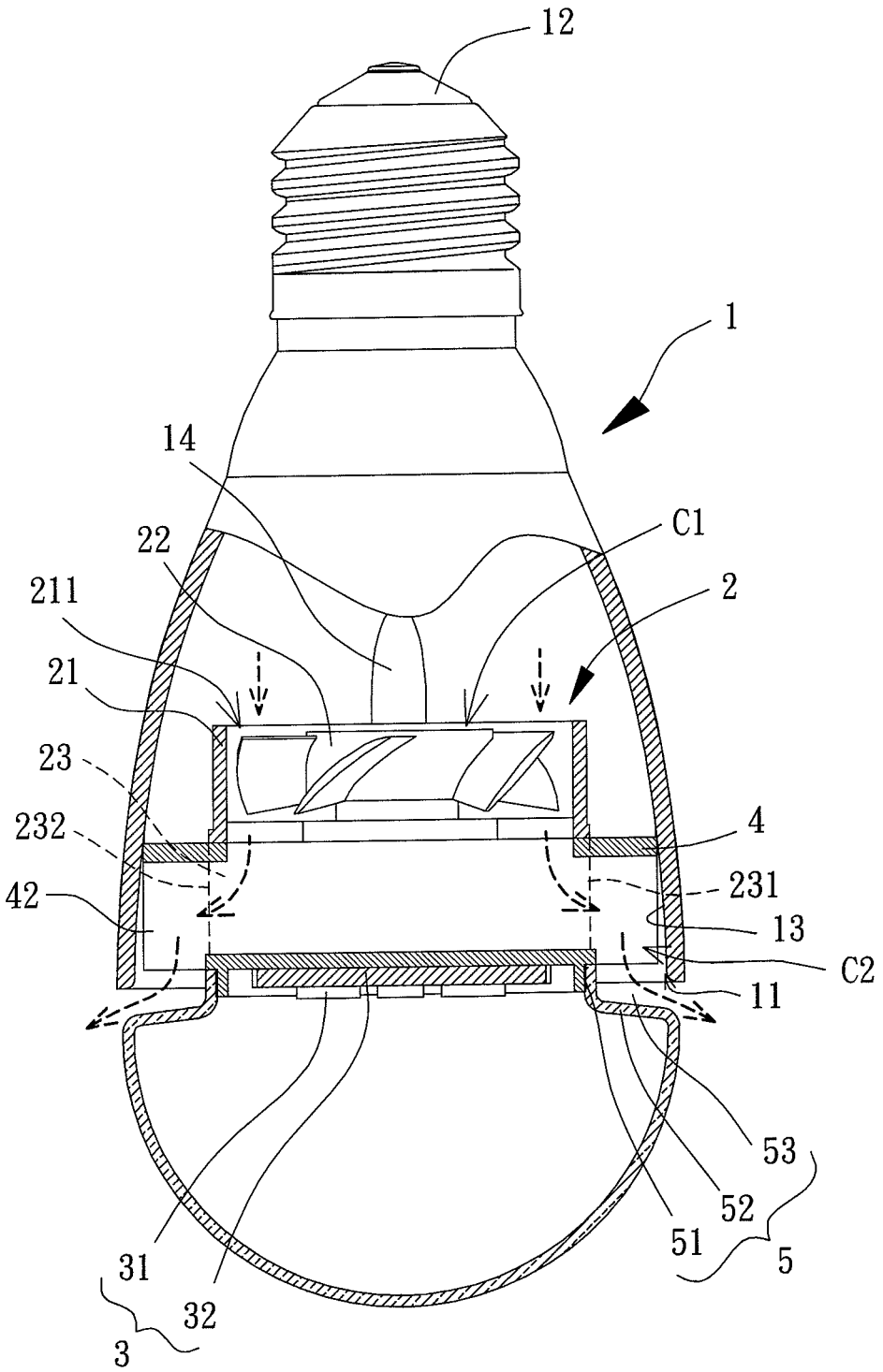
FIG. 6 shows a cross-sectional view of the lamp according to the first embodiment observed at line 6-6 in FIG. 4.

Referring to FIGS. 4, 5 and 6, the cooling fan 2 also has at least one partitioning board 23 positioned between the air-guiding wall 13 and the air channel 211 for defining at least one first air-guiding opening "C1" and at least one second air-guiding opening "C2" at the assembling opening 11 of the housing 1. The first and second air-guiding openings "C1," "C2" respectively serve as an air inlet and an air outlet, such as taking the second air-guiding opening "C2" as the air outlet if the first air-guiding opening "C1" serves as the air inlet, or, alternatively, the first air-guiding opening "C1" serves as the air outlet when the second air-guiding opening "C2" serves as the air-inlet. Furthermore, the at least one partitioning board 23 can be provided by integrally formed on the casing 21 and extending from lateral edges of the casing 21. However, the at least one partitioning board 23 can also be detachably mounted on the casing 21.

In this embodiment, the number of the at least one partitioning board 23 is two while these two partitioning boards 23 are integrally formed at two lateral edges of the casing 21 respectively and extend toward the assembling opening 11 axially. Referring to FIG. 4, due to the arrangement of the two partitioning boards 23, the number of the at least one first air-guiding opening "C1" is two, and each of these two first air-guiding openings "C1" is defined between the air-guiding wall 13 of the housing 1 and a respective one of the two partitioning boards 23; on the other hand, the number of the at least one second air-guiding opening "C2" is one, and the second air-guiding opening "C2" is defined between the two partitioning boards 23 and the air channel 211. Referring to FIGS. 3 and 4 again, both of the partitioning boards 23 have a first end 231 and a second end 232 and the first and second ends 231, 232 respectively face the air-guiding wall 13 in two opposite directions. Furthermore, it is preferable that the first and second ends 231, 232 of each partitioning boards 23 abut against the air-guiding wall 13, so that the first and second air-guiding openings "C1," "C2" are totally separated and thus air turbulence between the first and second air-guiding openings "C1," "C2" are actually avoided in operation of the cooling fan 2. As a result, low operating noise and improved airflow smoothness are achieved.

The light-emitting module 3 is arranged in the housing 1 and includes a light-emitting element 31 and a control board 32. The light-emitting element 31 may be a light-emitting device (LED) module, bulb or other devices with light-emitting function. The control board 32 is electrically connected to the light-emitting element 31 so that the control board 32 can control the light-emitting element 31 to emit light. In the embodiment, the light-emitting element 31 is implemented as the LED module for longer service life and power saving. The control board 32 is electrically connected to the electrical base 12 of the housing 1.

Referring to FIGS. 3, 4 and 5 again, the said heat sink 4 is made of material with high heat conductivity. Preferably, the heat sink 4 is mounted on the cooling fan 2 to be fixed inside the housing 1 through the cooling fan 2. The heat sink 4 includes a base plate 41 abutting against the partitioning boards 23 of the cooling fan 2 to ensure that the airflow may smoothly be inhaled into and expelled from the housing 1 via the first and second air-guiding openings "C1," "C2." Moreover, preferably, there is a plurality of fixing poles 14 inside the housing 1, with a plurality of assembling poles 411 formed on outer edges of the base plate 41 and corresponding to the plurality of fixing poles 14. Accordingly, the heat sink 4 may be accurately positioned at the assembling opening 11 via fixing members "F" (such as screws) extending into the fixing poles 14 through the assembling poles 411, so as to improve the convenience in assembly. Besides, the control board 32 of the light-emitting module 3 can also be mounted on the base plate 41 of the heat sink 4, so that the cooling fan 2 and the heat sink 4 may operate cooperatively to efficiently dissipate the heat generated by the light-emitting module 3.

Preferably, the heat sink 4 further includes a plurality of fins 42 spaced from each other and located between the two partitioning boards 23. In such an arrangement, the fins 42 may increase the heat exchange areas when the cooling fan 2 guides the air to pass through the air channel 211 and the second air-guiding opening "C2," and thus the heat dissipation efficiency of the provided lamp can be improved.

Referring to FIGS. 3, 5 and 6, the said embodiment of the lamp of the invention preferably includes a light-permeable hood 5 coupled with the heat sink 4. The light-permeable hood 5 has an opening portion 51. The light-emitting module 3 is received in the light-permeable hood 5 through the opening portion 51. In such an arrangement, the light-emitting module 3 may emit light through the light-permeable hood 5. In addition, the light-permeable hood 5 can be of different colors or types to produce different illumination effects. Moreover, the light-permeable hood 5 can also serve the purpose of protecting the light-emitting module 3. In overall, the light-permeable hood 5 can provide different illumination effects while protecting the light-emitting module 3.

Referring to FIGS. 5 and 6 again, the light-permeable hood 5 has an air-guiding shoulder portion 52 on a periphery thereof, with the air-guiding shoulder portion 52 being adjacent to the opening portion 51. In such an arrangement, an air-guiding gap 53 may be formed between the air-guiding shoulder portion 52 and one end of the housing 1 adjacent to the assembling opening 11. As such, the cooling fan 2 will guide the air to flow into and out of the housing 1 in a horizontal direction through the air-guiding gap 53 (from the first air-guiding opening "C1" to the second air-guiding opening "C2," or from the second air-guiding opening "C2" to the first air-guiding opening "C1"). Based on this, the air-guiding shoulder portion 52 can facilitate the flowing of the air passing through the air-guiding gap 53. With the air-guiding shoulder portion 52, the air flowing of the lamp can be facilitated.

When the first embodiment of the lamp of the invention is in use, the lamp can be installed in places where illumination is required, such as wall, ceiling and so on. As an example, the housing 1 of the lamp can be partially inserted into the decorative ceiling in a way that the assembling opening 11 of the housing 1 and the light-emitting element 31 of the light-emitting module 3 are located outside the confined space beneath the decorative ceiling. In addition, since the first air-guiding opening "C1" and the second air-guiding opening "C2" are formed by dividing the assembling opening 11 by partitioning boards 23 of the cooling fan 2, the first and second air-guiding openings "C1," "C2" are allowed to locate beneath the decorative ceiling to communicate with external air. Moreover, the electrical base 12 of the housing 1 can be electrically connected to a general power-supplying system that provides required power to the control board 32 of the light-emitting module 3. As such, the control board 32 of the light-emitting module 3 can control the light-emitting element 31 to emit light. When the fan wheel 22 of the cooling fan 2 is rotated, referring to FIG. 5, the external air can be drawn into the housing 1 and the air channel 211 of the cooling fan 2 via the first air-guiding opening "C1," and the air in the housing 1 and the air channel 211 can be expelled via the second air-guiding opening "C2" (as shown in FIG. 6). Thus, the heat generated by the light-emitting module 3 can be dissipated.

Based on the disclosed structure of the lamp, the first embodiment thereof is characterized in forming the first air-guiding opening "C1" and the second air-guiding opening "C2" through arrangement of the partitioning boards 23 of the cooling fan 2 at the assembling opening 11. Specifically, when the cooling fan 2 is disposed at the assembling opening 11 of the housing 1, the first air-guiding opening "C1" is formed between the air-guiding wall 13 and either one of the two partitioning boards 23, and the second air-guiding opening "C2" is formed between the air channel 211 and the air-guiding wall 13. Therefore, the first embodiment of the lamp of the invention may use the assembling opening 11 constructed for assembling purpose to form the first air-guiding opening "C1" and the second air-guiding opening "C2." This omits the need of forming any additional air inlet or outlet on the housing 1. As an advantage, the overall structural complexity and costs are reduced and the manufacturing convenience is also improved.

Furthermore, when the first embodiment of the lamp of the invention is partially inserted into the decorative ceiling, the first air-guiding opening "C1" and the second air-guiding opening "C2" can also locate outside the confined space beneath the decorative ceiling where the light-emitting module 3 locates. Based on the design, the cooling fan 2 can smoothly guide the air to flow into and out of the lamp, thereby improving the overall heat dissipation efficiency and prolonging the service life of the lamp.

Figure 7:
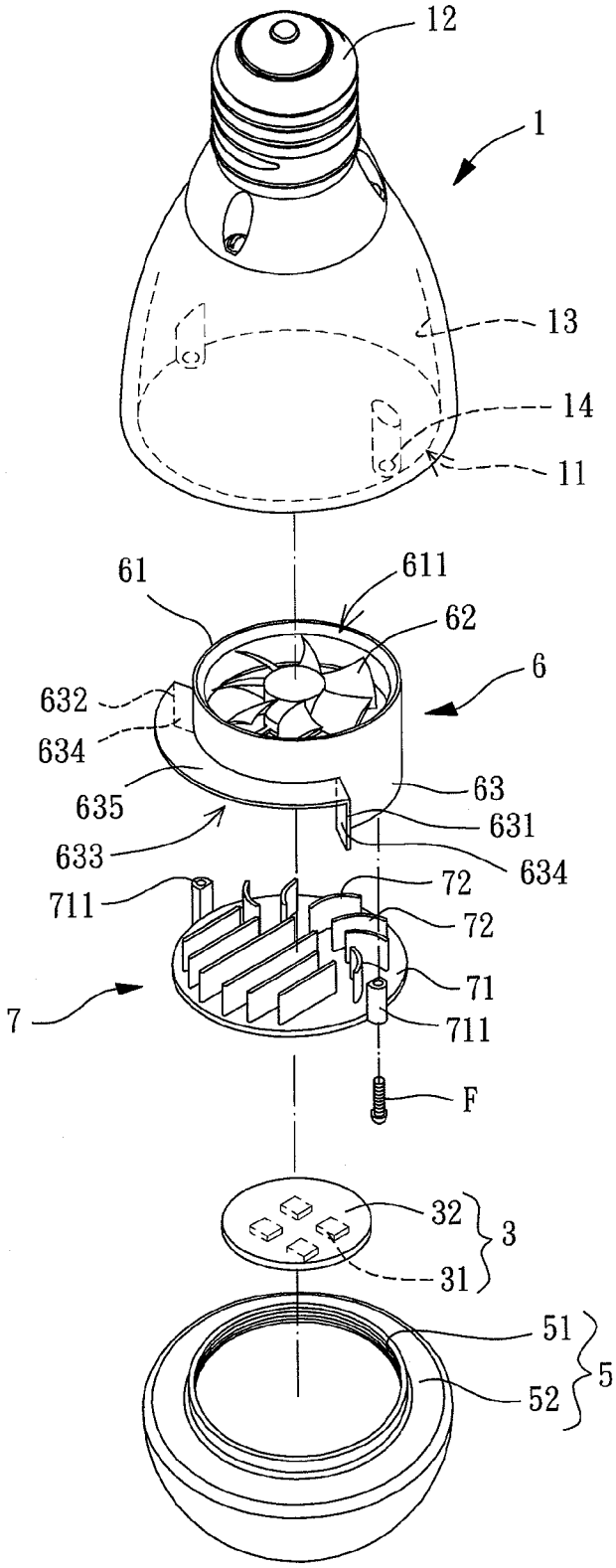
FIG. 7 shows an exploded diagram of a lamp according to a second embodiment of the invention.
Figure 8:
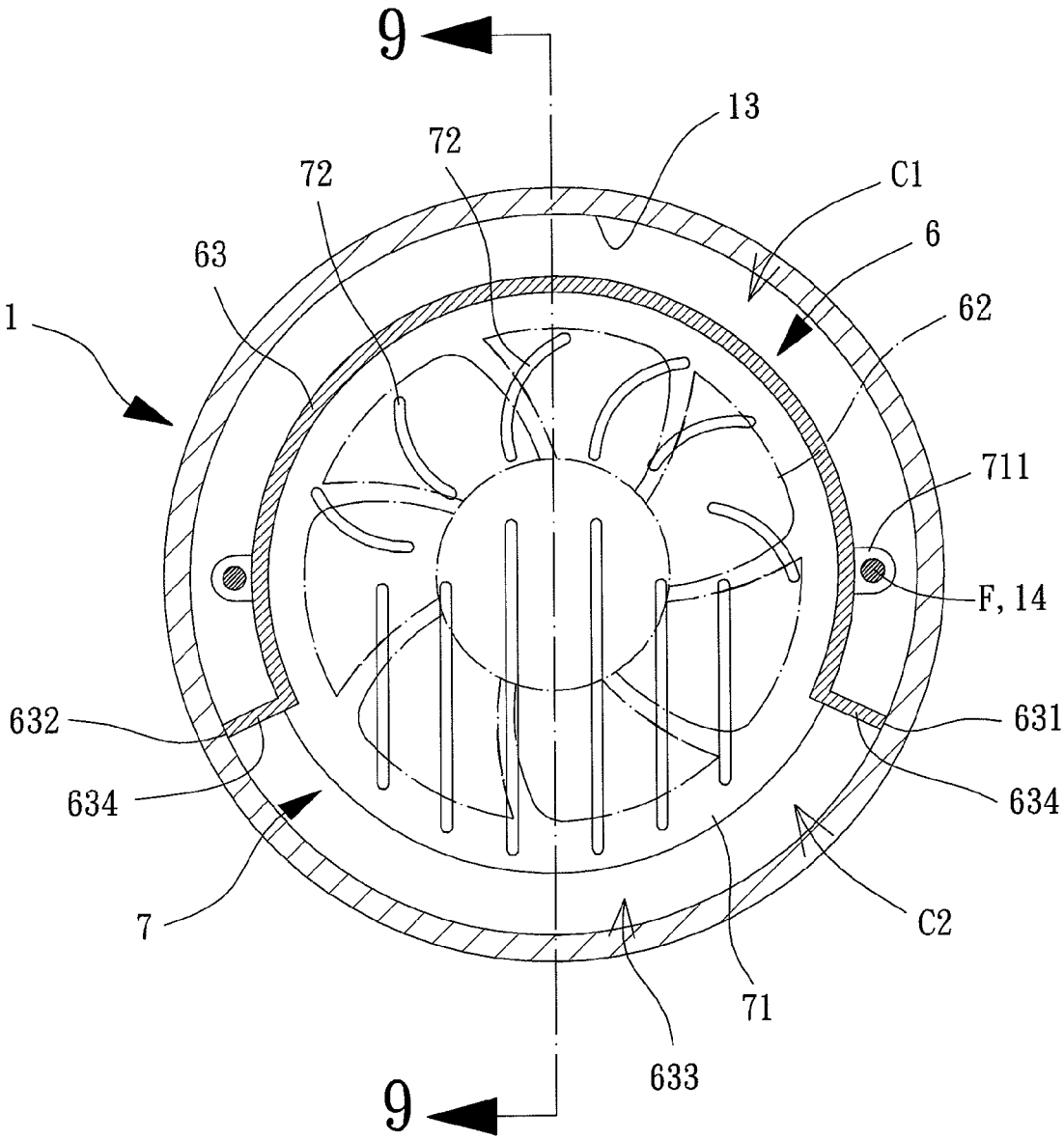
FIG. 8 shows a cross-sectional view of the lamp according to the second embodiment of the invention.
Figure 9:
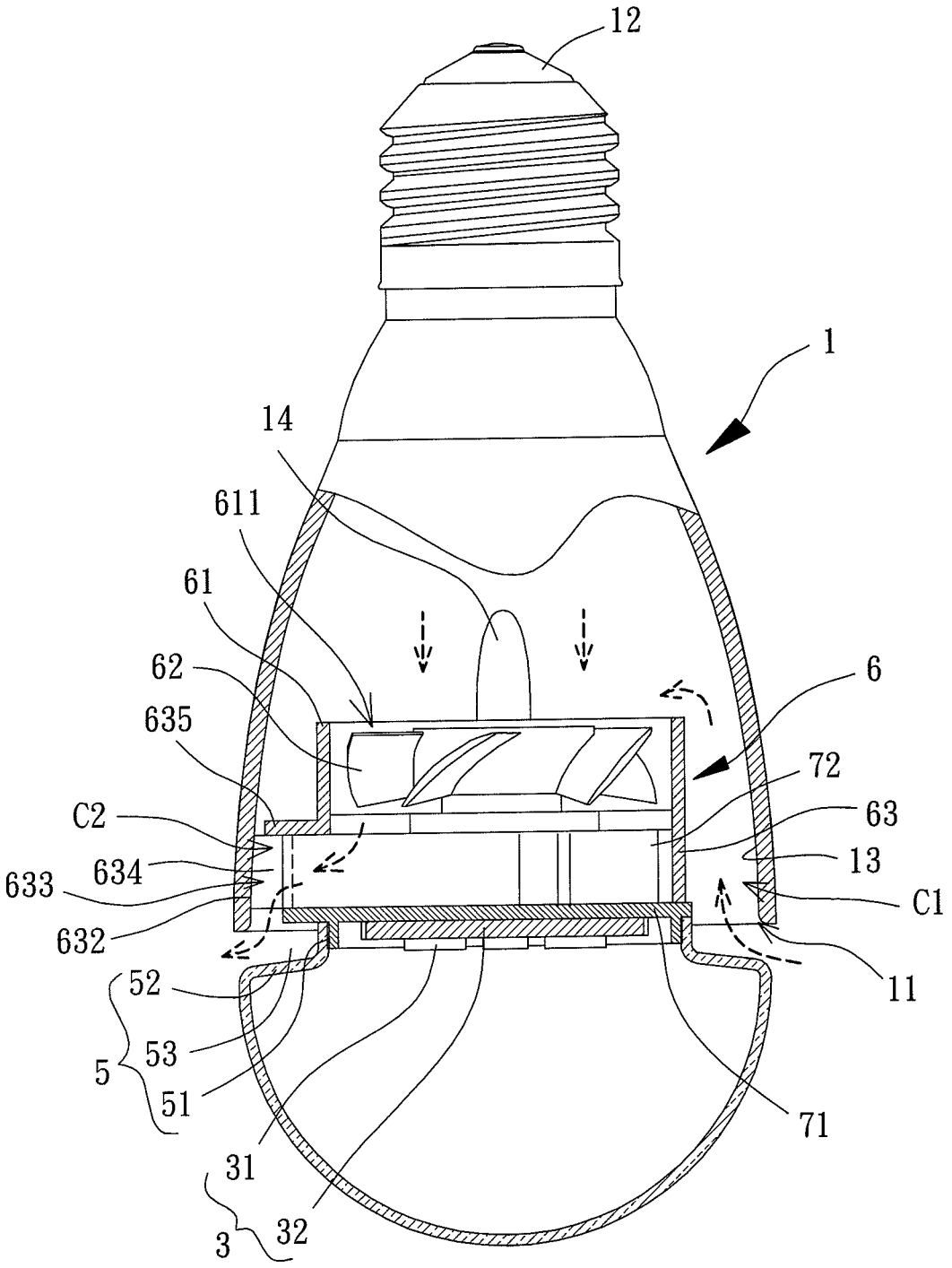
FIG. 9 shows a cross-sectional view of the lamp according to the second embodiment observed at line 9-9 in FIG. 8.

Please refer to FIGS. 7, 8 and 9, which discloses a second embodiment of the present invention. In comparison with the elements of the above-mentioned first embodiment of the present invention, this second embodiment of the present invention has a cooling fan 6 and a heat sink 7 to replace the cooling fan 2 and heat sink 4 of the first embodiment, while the housing 1, light-emitting module 3 and light-permeable hood 5 are still used in this embodiment.

In this second embodiment, the cooling fan 6 has a casing 61 disposed at the assembling opening 11 of the housing 1, with an air channel 611 formed in the casing 61 for air current to pass through, and a fan wheel 62 of the cooling fan 6 is rotatably arranged in the air channel 611. Furthermore, the casing 61 has a partitioning board 63 on a side facing the assembling opening 11, with the partitioning board 63 extending in a C shape to provide a first end 631 and a second end 632 facing the air-guiding wall 13. Referring to FIG. 8 again, a first air-guiding opening "C1" is defined between the air-guiding wall 13 of the housing 1 and an outer surface of the partitioning board 63, and a second air-guiding opening "C2" is defined between an inner surface of the partitioning board 63 and the air channel 611. Preferably, the first and second ends 631, 632 abut against the air-guiding wall 13, so that the first and second air-guiding openings "C1," "C2" are totally separated and thus air turbulence between the first and second air-guiding openings "C1," "C2" are actually avoided in operation of the cooling fan 6.

In this embodiment, a lateral opening 633 is formed at the C-shaped partitioning board 63, which is the opening of the C shape, and two side flanges 634 are respectively formed on two opposite sides of the lateral opening 633, wherein an end of one of the side flanges 634 serves as the first end 631 and an end of the other one of the side flanges 634 serves as the second end 632. The first end 631 and the second end 632 abut against the air-guiding wall 13 of the housing 1 respectively. Specifically, the side flanges 634 can be provided by integrally formed or detachably mounted on the said opposite sides of the lateral opening 633. Preferably, a blocking flange 635 may further be arranged on a top side of the lateral opening 633. The blocking flange 635 can be provided by integrally formed or detachably mounted on the said top side of the lateral opening 633. The blocking flange 635 extends to and preferably abuts against the air-guiding wall 13 of the housing 1, with the blocking flange 635 disposed between the two side flanges 634 to separate the first and second air-guiding openings "C1," "C2." Therefore, the cooling fan 6 having the side flanges 634 and blocking flange 635 can smoothly guide the air to flow into and out of the housing 1 via the first and second air-guiding openings "C1," "C2."

The heat sink 7 includes a base plate 71 having a plurality of assembling poles 711 formed on outer edges thereof and corresponding to the plurality of fixing poles 14. Accordingly, the heat sink 7 may be accurately positioned at the assembling opening 11 via fixing members "F" (such as screws) extending into the fixing poles 14 through the assembling poles 711, so as to improve the convenience in assembly. Besides, the base plate 71 can be abutted by the partitioning board 63. Preferably, the heat sink 7 further includes a plurality of fins 72 spaced from each other and surrounded by the C-shaped partitioning board 63. In such an arrangement, the fins 72 may increase the heat exchange areas when the cooling fan 6 guides the air to pass through the air channel 611 and the second air-guiding opening "C2," and thus the heat dissipation efficiency of the provided lamp can be improved.

When the fan wheel 62 of the cooling fan 6 is rotated, referring to FIG. 9, the external air can be drawn into the housing 1 and the air channel 611 of the cooling fan 6 via the first air-guiding opening "C1," and the air in the housing 1 and the air channel 611 can be expelled via the second air-guiding opening "C2." Thus, the heat generated by the light-emitting module 3 can be dissipated.

Based on the disclosed structure of the lamp of this embodiment, it is unnecessary to form any additional air inlet or outlet on the housing 1, and the first air-guiding opening "C1" and the second air-guiding opening "C2" can also locate outside the confined space beneath the decorative ceiling where the light-emitting module 3 locates for the cooling fan 6 to smoothly guide the air to flow into and out of the lamp. Specifically, in comparison with the first embodiment, the second embodiment of the present lamp is characterized in forming only one first air-guiding opening "C1" and one second air-guiding opening "C2" through arrangement of the C shaped partitioning board 63, and thus the air passing through the first and second air-guiding openings "C1," "C2" is concentrated. Furthermore, with the side flanges 634 or the blocking flange 635, the air expelled by the second air-guiding opening "C2" may not easily flow back to the inner of the housing 1 and the first air-guiding opening "C1," so as to avoid air turbulence.

In conclusion, the lamp of the invention does not require forming any air inlet or air outlet on the housing 1 as the air can flow into and out of the housing 1 through the first air-guiding opening "C1" and the second air-guiding opening "C2." Thus, the lamp of the invention will have a simplifier structure, which provides convenient manufacturing of the lamp. Furthermore, when the lamp is partially inserted into the decorative ceiling, the first air-guiding opening "C1" and the second air-guiding opening "C2" can allow the external air to pass through the lamp for heat dissipation. Thus, the service life of the lamp is prolonged.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A lamp, comprising:

a housing having an assembling opening and an electrical base on two ends thereof, wherein the housing has an inner wall, and a portion of the inner wall adjacent to the assembling opening is an air-guiding wall;

a cooling fan having a casing, a fan wheel and a partitioning board, wherein the casing is disposed at the assembling opening and forming an air channel therein, the fan wheel is rotatably arranged in the air channel, and the partitioning board is arranged between the air-guiding wall of the housing and the air channel, with the partitioning board including a C shape defining a lateral opening having a first end and a second end, with the first and second ends facing and abutting against the air-guiding wall of the housing respectively so as to define at least one first air-guiding opening and at least one second air-guiding opening; and a light-emitting module arranged in the housing.

2. The lamp as claimed in claim 1, wherein two side flanges are respectively formed on two opposite sides of the lateral opening, an end of one of the side flanges serves as the first end, and an end of the other one of the side flanges serves as the second end.

3. The lamp as claimed in claim 2, wherein a blocking flange is arranged on a top side of the lateral opening, which links the said opposite sides of the lateral opening, and the blocking flange is arranged between the two side flanges.

4. The lamp as claimed in claim 1 further comprising a heat sink having a base plate fixed inside the housing, with the cooling fan and the light-emitting module mounted on the base plate.

5. The lamp as claimed in claim 4, wherein the heat sink has a plurality of fins spaced from each other and surrounded by the partitioning board.

6. The lamp as claimed in claim 4, wherein the partitioning board of the cooling fan abuts against the base plate of the heat sink.

7. The lamp as claimed in claim 4 further comprising a light-permeable hood coupled with the heat sink, wherein the light-permeable hood has an opening portion and the light-emitting module is received in the light-permeable hood through the opening portion.

8. The lamp as claimed in claim 7, wherein the light-permeable hood has an air-guiding shoulder portion, and an air-guiding gap is formed between the air-guiding shoulder portion and one end of the housing adjacent to the assembling opening.

9. The lamp as claimed in claim 4, wherein a plurality of fixing poles is arranged inside the housing, a plurality of assembling poles is formed on outer edges of the base plate and corresponding to the plurality of fixing poles, and a plurality of fixing members extends into and fastened on the fixing poles through the assembling poles.

10. The lamp as claimed in claim 1, wherein the housing is closed between the assembling opening and the electrical base.

11. The lamp as claimed in claim 1, wherein the partitioning board is integrally formed on the casing.

12. The lamp as claimed in claim 1, wherein the partitioning board is detachably mounted on the casing.

* * * * *